US006024619A

United States Patent [19]

Mori et al.

[11] Patent Number: 6,024,619

[45] Date of Patent: Feb. 15, 2000

[54] METHOD FOR MANUFACTURING A FLAT DISPLAY PANEL DEVICE

[75] Inventors: Hiroshi Mori; Akio Mishima; Eitaro Yoshikawa, all of Kanagawa, Japan

[73] Assignee: Sony Corporation, Japan

[21] Appl. No.: 09/182,460

[22] Filed: Oct. 30, 1998

[30] Foreign Application Priority Data

Oct. 31, 1997 [JP] Japan ..... 9-301198

[51] Int. Cl.[7] ..... H01J 9/227

[52] U.S. Cl. ..... 445/24

[58] Field of Search ..... 445/24

[56] References Cited

U.S. PATENT DOCUMENTS 5,703,433 12/1997 Fujii et al. ..... 313/484

FOREIGN PATENT DOCUMENTS

0798081 A1 10/1997 European Pat. Off. .
040101777 4/1992 Japan .
050314909 11/1993 Japan .
080273543 10/1996 Japan .

*Primary Examiner*—Kenneth J. Ramsey
*Attorney, Agent, or Firm*—Rader, Fishman & Grauer; Ronald P. Kananen

[57] ABSTRACT

This invention relates to a method for manufacturing a flat display panel device suitable for being applied to a plasma display panel and the like. In the method comprising forming a barrier-ridge-forming layer over a whole surface of a substrate having an electrode pattern, then removing from barrier-ridge-forming layer the unnecessary portions by jetting an abrasive, so as to form a barrier ridge, and further filling the removed portions with fluorescent paste layer and removing from fluorescent paste layer the unnecessary portions by jetting the abrasive until a given discharge space can be kept. Organic material particles coated with an inorganic material are used as the abrasive for removing the barrier-ridge-forming layer and/or the fluorescent paste layer. By coating the organic material with the inorganic material, the abrasive particles become roundish. Thus, even if these are used as the abrasive, it is not feared that they injury the surfaces of the glass substrate and the address electrode.

14 Claims, 8 Drawing Sheets

METHOD FOR MANUFACTURING A FLAT DISPLAY PANEL DEVICE

BACKGROUND OF THE INVENTION

1. Field of the Invention

This invention relates to a method for manufacturing a flat display panel device suitable for being applied to a plasma display panel and the like. More specifically, the invention relates to a method wherein, when at least barrier ridges are formed by a jet treatment using an abrasive (sandblast), damages of a substrate and/or electrodes formed on the substrate are reduced as much as possible by using organic material particles coated with an inorganic material as the abrasive, so that improvement in variations in luminous brightness and the like can be attained.

2. Description of the Prior Art

Hitherto, as a display device for displaying images, various types have been suggested, such as a CRT display device or a liquid crystal device. In recent years, highly minute display methods such as HDTV (High Definition TV) have been made practicable. Following this, display devices are becoming large-sized and highly minute.

The CRT display device and the like have such a problem that they cannot be structurally adapted to the advance toward large-sized devices. Further, the liquid display device, which is spotlighted as a flat display panel device, also has problems that high luminous brightness cannot be obtained and its structure is complicated, and that it is difficult that the device is made large-sized, except for a projection type device.

On the other hand, in a plasma display device (plasma display panel) (PDP)) using plasma, a high luminous brightness can be obtained, although its structure is relatively simple. Besides, it can be made large-sized. Thus, in recent years, it has greatly been demanded to make the PDP practicable as a flat display panel.

As is well known, the PDP device comprises two glass substrates, pattern electrodes arranged in a very small space formed by barrier ridges between the two glass substrates and fluorescent substance layers (R, G and B) formed in the spaces so as to cover the surfaces of electrodes wherein discharge gas is injected into the spaces, this space is formed as a cell (pixel), and a large number of the same cells are arranged in a matrix form.

FIG. 1 is a cross sectional view showing essential parts of an example of a color PDP device 10. The device shown in this figure is a color PDP device driving cells in an alternating current system.

The PDP device 10 is composed of a back side section 10A, a front side section 10B, and an image display section (display cell) 20 arranged between them. The back side section 10A is provided with a glass substrate 12 having predetermined thickness and size. Address electrodes 14 (14R, 14G and 14B) are adhered to the surface of the glass substrate 12 with keeping a given interval between them.

In the intermediate portions between the address electrodes 14, barrier ridges 16 having predetermined height and width are formed in parallel to the address electrodes 14. In this example, inside very small spaces (display cells) 20 (20R, 20G and 20B) put between these barrier ridges 16, three different sorts of the fluorescent substances 18 are alternately formed at predetermined repeated pitches, so as to cover the address electrodes 14. Each of said fluorescent substances 18 (18R, 18G and 18B) emits a fluorescent color light of a red (R), a green (G), or a blue (B).

The front side section 10B opposite to the back side section 10A also has a glass substrate 22 for the front side. As also shown in FIGS. 1 and 2, display electrodes 24, which are transparent electrodes, are arranged on the lower surface side of the glass substrate 22 and formed at given intervals along the direction perpendicular to the address electrodes 14. Furthermore, display electrodes 26 for bus lines, which are narrower than the display electrodes 24, are formed on the upper surface side of the display electrodes 24. A protective layer (for example, MgO) 28 is deposited on the electrodes 24 and 26 so that said layer 28 may cover the whole of these electrodes 24 and 26.

The front side section 10B is sealed in a state that its protective layer 28 contacts the barrier ridges 16, and thus, the section 10B is integrated with the back side section 10A. Thereby, the PDP device is formed. The respective display cells 20 are filled with discharge gas. By electric discharge between the opposite electrodes in the respective display cells, the discharge gas is excited. By ultraviolet rays generated when the excited discharged gas returns to the ground state, the fluorescent substances 18 emit light, causing luminescence of the display cells (pixels).

Incidentally, the barrier ridges 16 formed between the aforementioned display cells are produced as follows. It is explained referring to FIG. 3.

First, glass particles are dispersed into a binder and thus, an inorganic paste is formed. As shown in FIG. 3, the inorganic paste is applied into a multilayer form by a screen print method over the whole surface of the glass substrate 12 having thereon the formed address electrodes 14, so as to form a barrier-ridge-forming layer (inorganic material layer) 16*a* having a certain film thickness. Thereafter, a mask 30*a* corresponding to the discharge space areas (cell areas) is made on the barrier-ridge-forming layer 16*a*, and then the exposed portions of the barrier-ridge-forming layer 16*a* are removed off by jet treatment. As shown in FIG. 1, by this treatment, unnecessary portions for the discharge space areas are removed from the barrier-ridge-forming layer 16*a* to form barrier ridges 16 having predetermined width and height.

Referring to FIG. 4, a method for forming the fluorescent substance layers 18 inside the discharge spaces having the exposed electrodes 14 will be explained. As shown in the FIG.4, after filling the discharge spaces with a fluorescent paste 21 and drying the paste, the fluorescent substance layer 21 is removed by jet treatment up to a given thickness as shown by the dotted line of FIG. 4. The layer is actually removed up to such a thickness that the plasma discharge spaces can be kept. Through this treatment, the display cells 20 (29R, 20G and 20B) are formed.

It is well known that particles with a large Mohs hardness such as calcium carbonate are used as the abrasive for the aforementioned jet treatment. However, it was proved that the surface of the glass substrate 12 or those of the address electrodes 14 formed on the glass substrate 12 were liable to be damaged by the jet treatment with an abrasive, in particular in the process for forming the barrier ridges 16 as shown in FIG. 3 because the abrasive was composed of angular particles as shown in FIG. 5. FIG. 6(A) shows results of measuring the surface roughness of the glass substrate 12 before the jet treatment. The measured results indicated that the surface was flat.

On the other hand, FIG. 6(B) shows results of measuring the surface roughness of the exposed glass substrate 12 having been subjected to the aforementioned jet treatment. The measured results indicated that the surface was damaged by the abrasive, as shown in the curve Pa of FIG. 6 (B) and consequently the surface became depressed.

Further, FIG. 7 shows an example of the particle size distribution of calcium carbonate used as the abrasive in the above case. The average particle size in the FIG. 7 is 19 $\mu$m, but fine particles having a particle size of 1 $\mu$m or less are considerably contained therein. Namely, when the accumulated amount of particles passed "through the sieve" is expressed by %, the percentage is shown by the curve La in FIG. 7. This curve La indicates the percentage (%) of particles having a certain particle size or less in the whole. From the example shown in FIG. 7, it can be understood that particles having a particle size of, for example, 1 $\mu$m or less account for about 20% of the whole particles.

When fine particles are numerous in the abrasive as described above, the fine particles are liable to adhere to the surface of the glass substrate 12 or those of the address electrodes 14. Since such the fine particles cannot be removed in subsequent steps, they remain on the surface as they are. As a result, surface roughness deteriorates. For example, the curve Pb shown in FIG. 6(B) indicates that the fine particles (particles of several $\mu$m or less size) in the abrasive adhere to the surface of the glass substrate 12.

Not only the surface of the glass substrate 12 but also those of the address electrodes 14 formed on the substrate 12 are subjected to the surface damage with the abrasive and the adhesion of the fine particles.

Where particles made of calcium carbonate or the like are used as the abrasive, not only the surface of the glass substrate but also those of the address electrodes 14 are liable to be damaged. In the case of FIG. 4, it is feared that said particles also damage the surface of the fluorescent substance layers removed unnecessary portions therefrom harder than required. Thus, luminous brightness is easily varied and operation voltage is also varied with ease. There is a drawback that any PDP device having a high quality cannot be obtained.

It has been investigated that as the abrasive other than calcium carbonate are used the materials which can be gasified by heating or burning, such as ethylcellulose particles or carbon particles (for example, Japanese Unexamined Patent Application publication No.101777/Heisei 4).

As for the abrasive described in this publication, particles thereof are liable to adhere to the processed face of glass substrate 12 or those of the address electrodes 14. It is difficult to uniformly process the surface with the particles and thus, resulting in a problem about processing quality. Therefore, said particles are not practical as the abrasive.

Alternatively, as abrasives other than these, silicon carbide, alumina, a glass bead and the like are used. As regards hardness thereof (Mohs), however, they have Mohs' hardness of 13, 12 and 6, respectively. Therefore, it is feared that any one of them injures the glass substrate (Mohs' hardness: 6) and the address electrodes (Mohs' hardness: 4).

SUMMARY OF THE INVENTION

This invention overcomes the drawbacks of conventional methods for manufacturing flat display panel device and it is an object of this invention to provide a manufacturing method making it possible to obtain a high-quality flat display panel device wherein the surface of the glass substrate and those of the address electrodes and/or that of the removed fluorescent substance layers are little damaged, and the variations in luminous brightness and operation voltages can be suppressed.

According to a first aspect of this invention we provide preferably a method for manufacturing a flat display-panel device comprising forming an electrode pattern on a substrate, forming a barrier-ridge-forming layer over a whole surface of a substrate having the electrode pattern and removing unnecessary portion from the barrier-ridge-forming layer by jetting an abrasive thereto, so as to form a barrier ridge wherein an organic material particle coated with an inorganic material is used as the abrasive for removing the unnecessary portions from the barrier-ridge-forming layer.

In this aspect, the organic material is coated with the inorganic material so that the particle becomes roundish. Therefore, even if such the particles are used as the abrasive, it is not feared that they damage the surfaces of the glass substrate and the address electrodes.

The Mohs' hardness of organic materials is in general smaller than that of the glass substrate or those of the address electrodes and, as a result, the organic materials are soft. Thus, there is a little danger that they injury the surface of the glass and the like. By coating the surface of the organic material, its particle size becomes larger. Fine particles of 1$\mu$m or less size hardly exist. In the example as shown below, fine particles of 10 $\mu$m or less size hardly exist. As a result, there is not a possibility that fine particles remain on the glass surface and the like so as to deteriorate its surface roughness.

Therefore, a high-quality flat display device can be obtained, which neither exhibits the variations in the luminous brightness nor these of the operation voltages. Thus, this invention is very suitable for being applied to method for manufacturing plasma display devices and the like.

Further, according to a second aspect of this invention we provide a method for manufacturing a flat display panel device comprising forming an electrode pattern on a substrate, forming a barrier-ridge-forming layer over a whole surface of the substrate having the electrode pattern, removing unnecessary portions from the barrier-ridge-forming layer by jetting an abrasive, so as to form a barrier ridge, filling the removed portion of the barrier-ridge-forming layer with fluorescent paste layer and further removing unnecessary portion from the fluorescent paste layer by jetting the abrasive until obtaining a given discharge space, wherein an organic material particle coated with an inorganic material is used as the abrasive for removing unnecessary portions from the barrier-ridge-forming layer and/or the fluorescent paste layer.

In the flat display panel device of this aspect, plasma is discharged in the given discharge space and thus, ultraviolet ray is generated. The ultraviolet ray is sent out to the fluorescent paste layer and the fluorescent paste layer irradiates color light, such as red, green and blue lights. Thus, color display is obtained. In other words, the method of this aspect is preferably applied to a method for manufacturing a color flat display panel device.

It is not feared that said abrasive particles also damage the surface of the fluorescent substance layers removed unnecessary portions therefrom harder than required.

A further understanding of the nature and advantages of this invention may be realized by reference to the following portions of the specification and drawings.

DETAILED DESCRIPTION OF THE PREFERRED EMBODIMENT

An embodiment of this invention where the invention is applied to a color PDP device will be specifically explained with reference to the drawings.

The inventors have made various investigations on abrasives for removing unnecessary portions from the barrier-ridge-forming layer and removing those from the fluorescent substance layer as described above, and consequently it has been found that when roundish particles, preferably spherical ones, that organic material is surface-treated with an inorganic material such as silicon are used, jet treatment is smoothly carried out without the glass substrate or address electrodes being damaged. On the basis of this finding, the present invention has been made.

That is, the present invention provides a method for manufacturing a flat display panel device wherein a barrier-ridge-forming layer is formed over a whole surface of a substrate having an electrode pattern, unnecessary portions are removed by jet treatment through a given mask so that a barrier ridge is formed, a fluorescent paste is then filled into these unnecessary portions and dried, and a part of the fluorescent substance which is positioned on the electrode pattern is removed by jet treatment, thereby forming a display cell, wherein substantially spherical organic material particle coated with an inorganic material is used as the abrasive for removing unnecessary portion from the barrier-ridge-forming layer and/or the fluorescent paste layer.

Referring to FIG. 8, an example of the method for manufacturing a color PDP device, to which the present invention is applied, is shown by this figure. This figure is in particular concerned with a back side section 10A.

Figure 1:
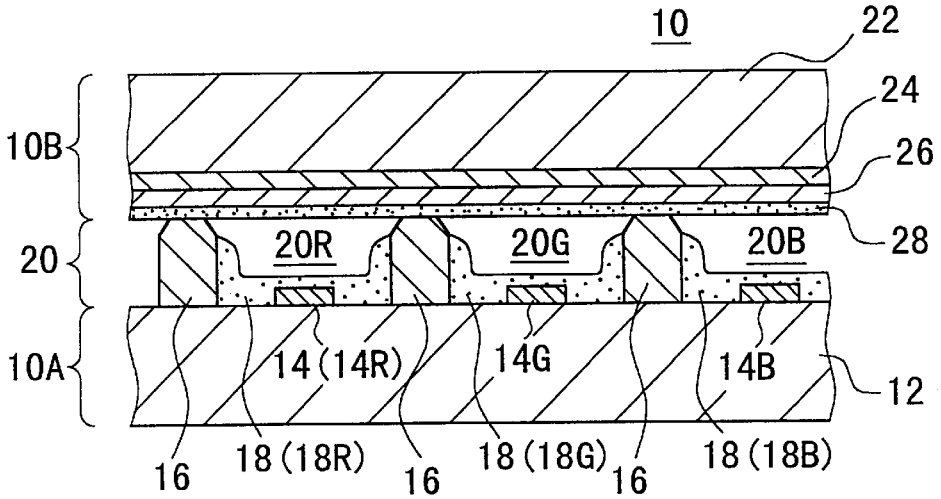
FIG. 1 (PRIOR ART)
FIG. 1 is a partial cross sectional view showing essential parts of an example of a conventional color PDP device.
Figure 2:
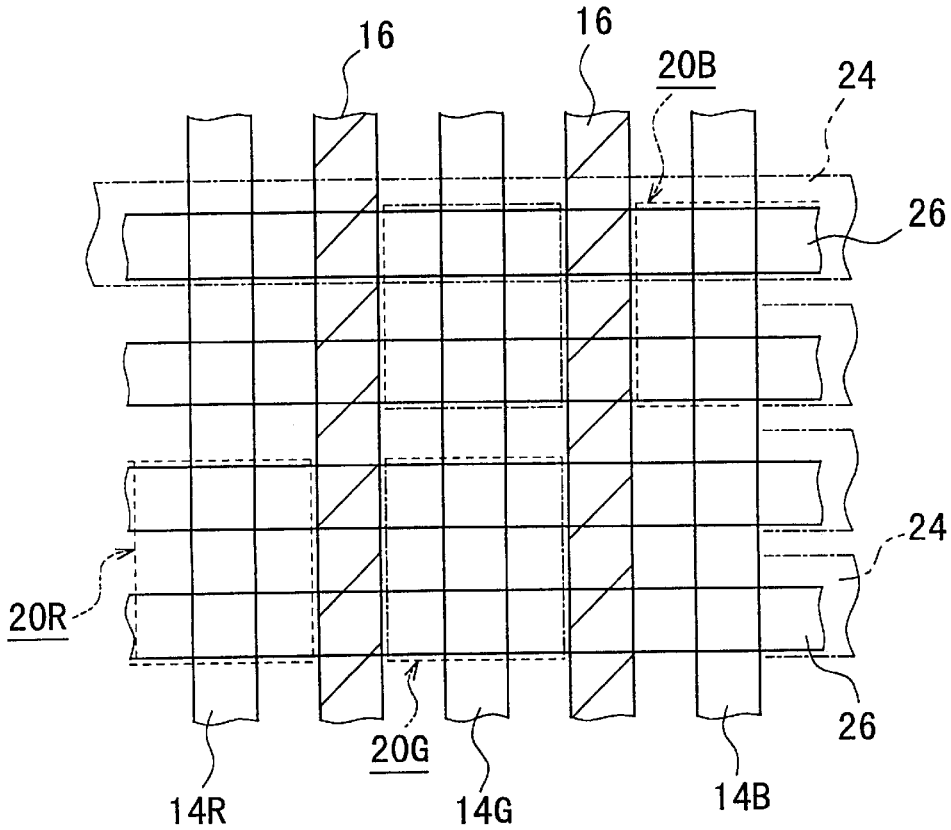
FIG. 2 (PRIOR ART)
FIG. 2 is a plane view showing essential parts of the conventional color PDP device as shown in FIG. 1.
Figure 3:
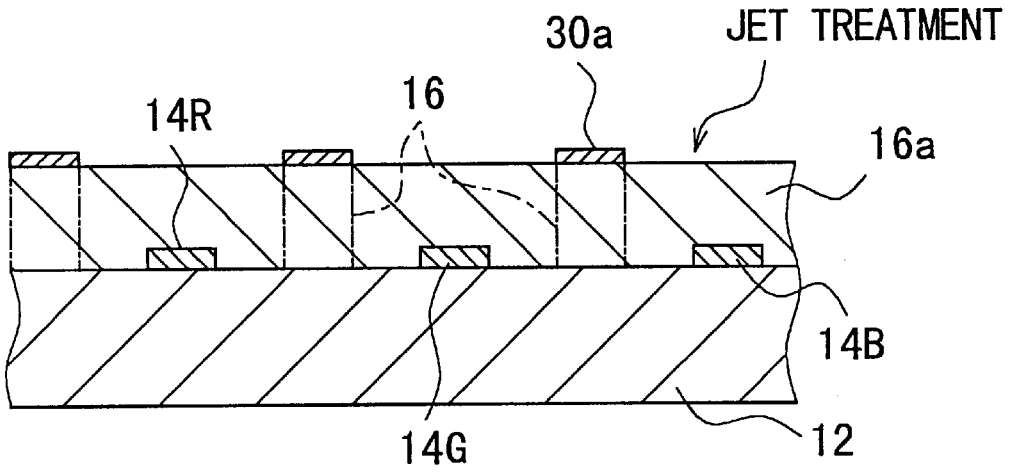
FIG. 3 (PRIOR ART)
FIG. 3 is a view showing the conventional steps of forming barrier ridges.
Figure 4:
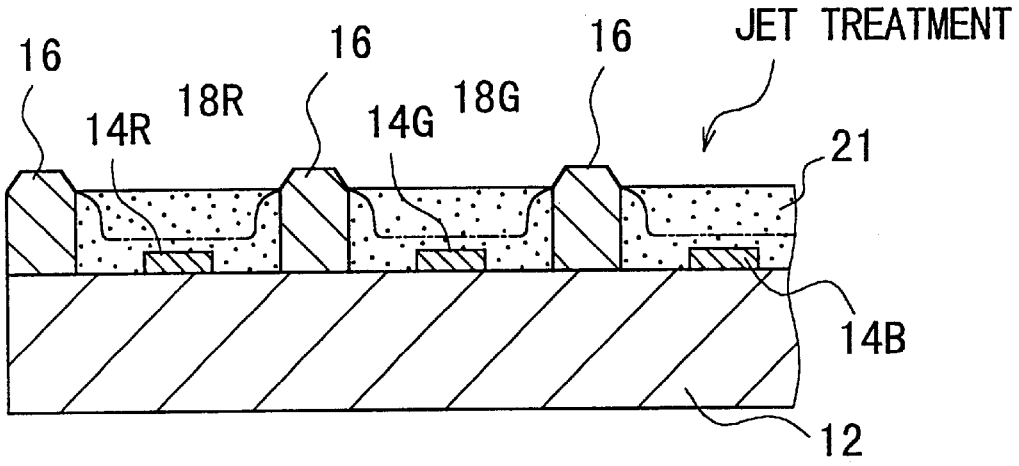
FIG. 4 (PRIOR ART)
FIG.4 is a view showing the conventional steps of removing unnecessary portion from a fluorescent substance.
Figure 5:
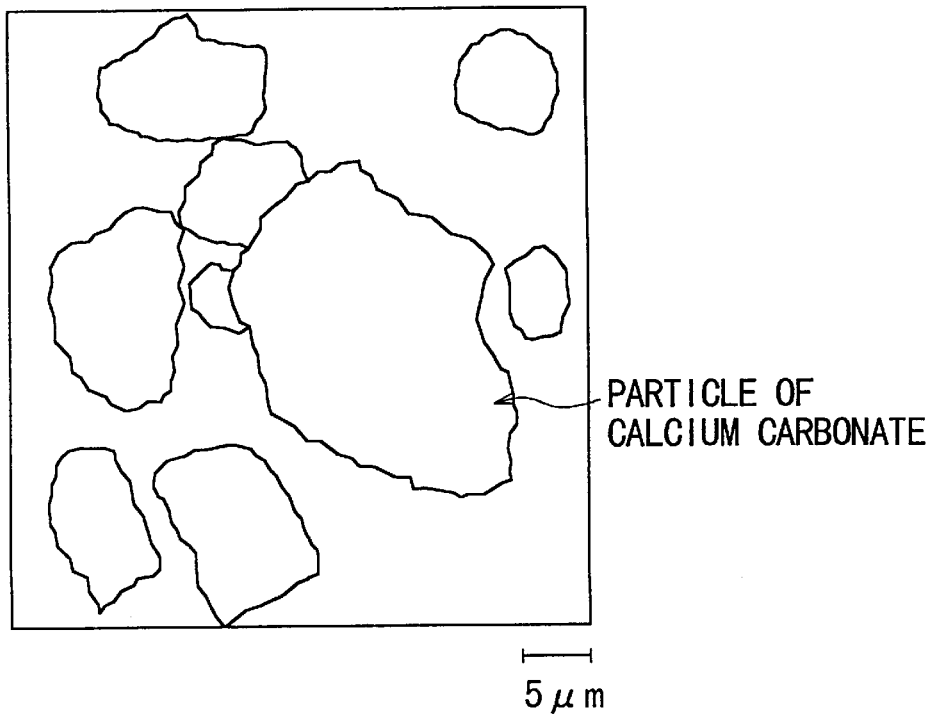
FIG. 5 (PRIOR ART)
FIG. 5 is a view showing particle sizes and shapes of a conventional abrasive.
Figure 7:
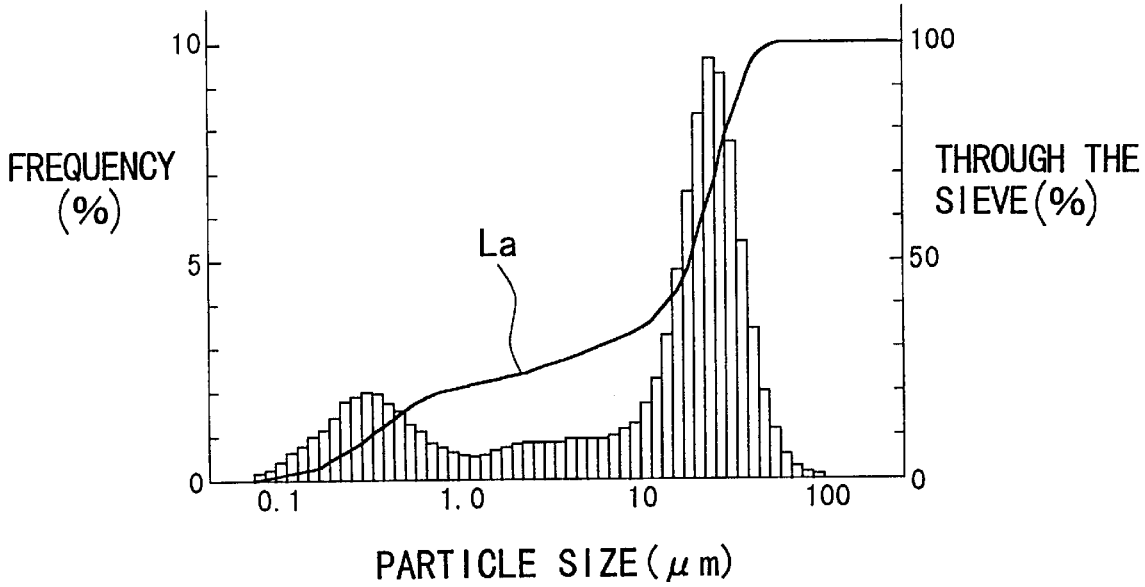
FIG. 7 (PRIOR ART)
FIG. 7 is a property view showing a relationship between particle size and frequency of a conventional abrasive.
Figure 6A:
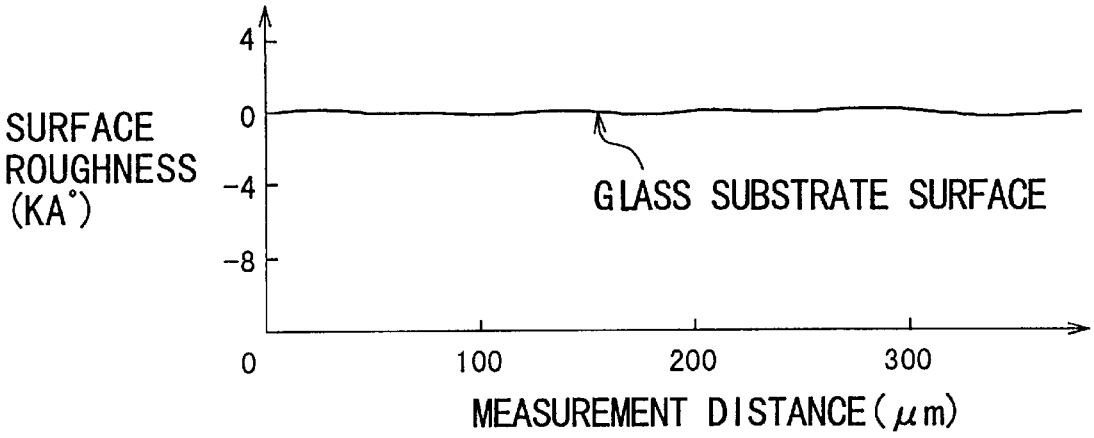
FIG. 6(A) (PRIOR ART)
FIGS. 6(A) and (B) are property views showing glass surface roughness before and after conventional jet treatment is carried out.
Figure 6B:
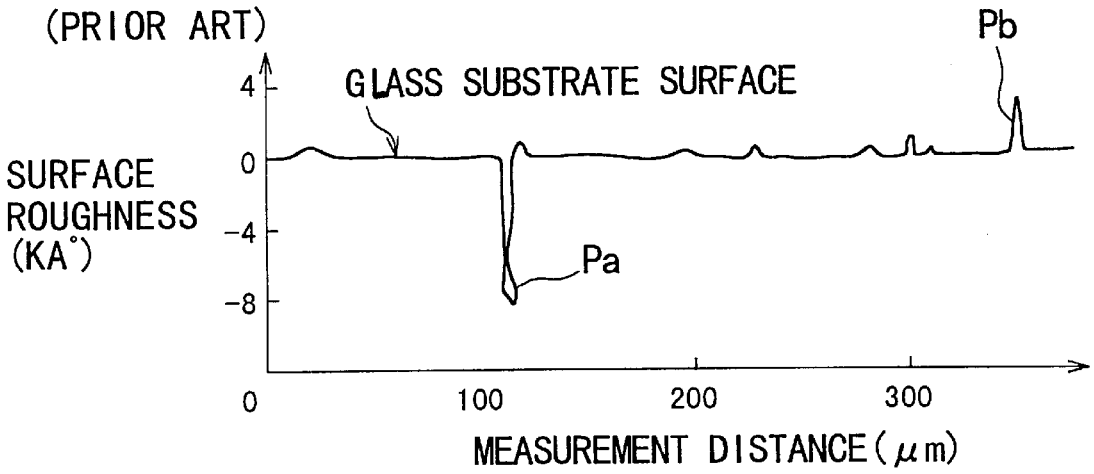
FIG. 6(B) (PRIOR ART)
Figure 8A:
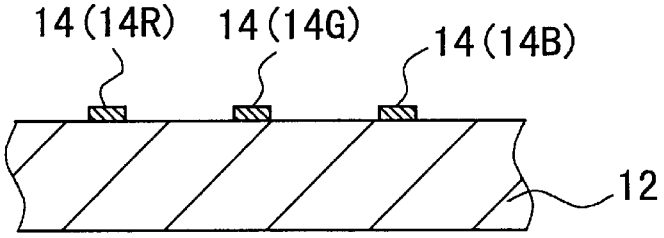
FIGS. 8(A) th rough (H) each is a process view showing a process for manufacturing a color PDP to which this invention is applied.
Figure 8B:
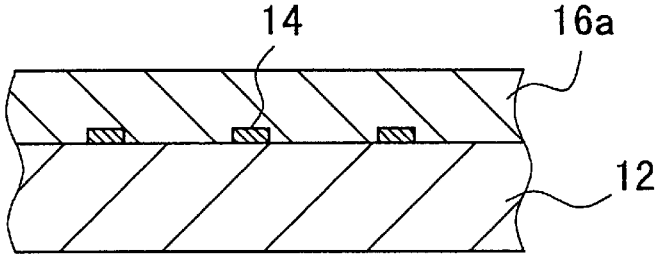
Figure 8C:
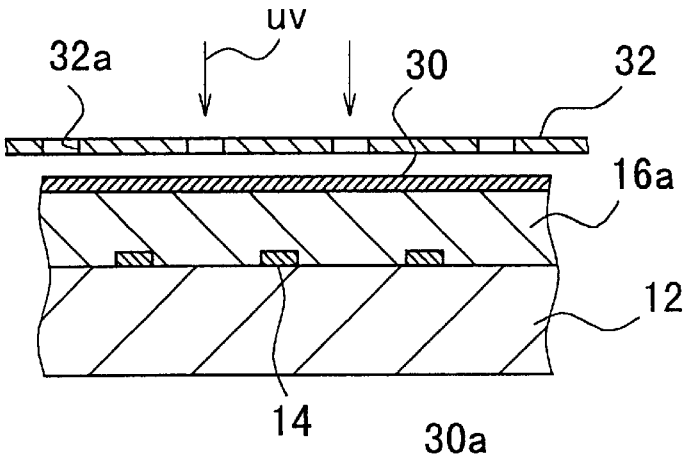
Figure 8D:
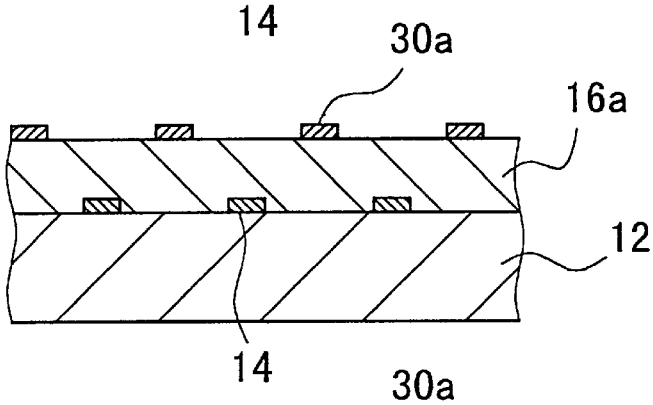
Figure 8E:
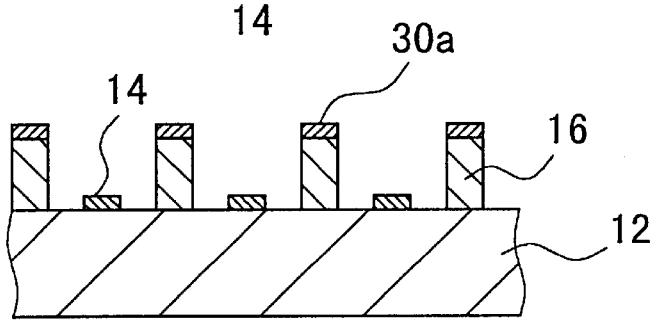
Figure 8F:
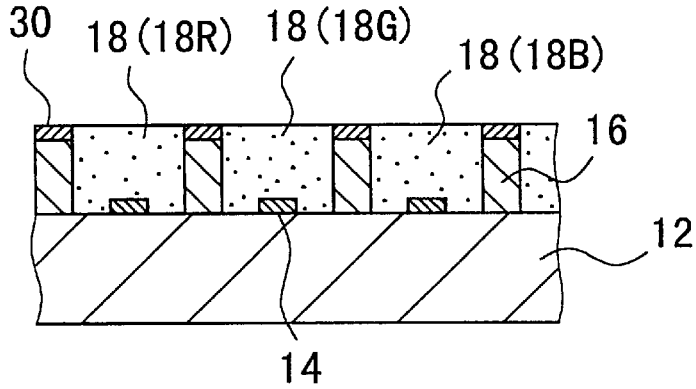
Figure 8G:
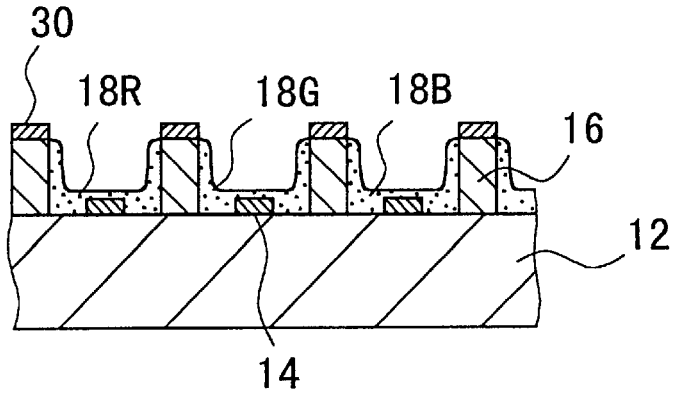

As shown in FIG. 8, in the manufacture of the back side section 10A including display cells, said section 10A of the color PDP device is obtained by successively conducting the following steps:

(1) the step of forming address electrodes 14 on a glass substrate 12 (FIG. 8(A)), (2) the step of forming a barrier-ridge-forming layer 16*a* over a whole surface of the glass substrate 12 (FIG. 8(B)), (3) the step of forming a resist mask 30 on the barrier-ridge-forming layer 16*a*, and removing by jet treatment unnecessary portions from the barrier-ridge-forming layer 16*a*, on which the mask 30 is not deposited, so as to form barrier ridges 16 (FIGS. 8(C), (D) and (E)), (4) the step of filling the removed portions from the barrier-ridge-forming layer 16*a* with a fluorescent substance paste 18 and then drying the paste (FIG. 8(F)), (5) the step of removing by jet treatment a part of the fluorescent substance layer 18, which is positioned on the electrodes 14 (FIG. 8(G)), and (6) the step of stripping and removing the mask 30 (FIG. 8B(H)).

In the above step (3) of the method of the present invention, at least the jet treatment (sandblasting treatment) is carried out by using the organic material surface-treated with the inorganic material as the abrasive.

Not only in the above barrier ridge forming step (3), but also in the above step (5) of removing a part of the fluorescent substance layer 18 on the electrodes 14, the jet treatment wherein the organic material particles, in a spherical form or a form similar thereto, whose surface is coated with the inorganic material is being used as the abrasive, is carried out. Alternatively, even where the barrier ridges 16 are formed by a processing method different from the jet treatment, the same jet treatment is carried out in the above step (5).

Next, on the basis of this embodiment, the present invention will be explained more specifically, but the present invention is not limited to this manufacturing process embodiment. Referring to FIG. 8 again, the explanation will be made.

As shown in FIG. 8(A), plural silver electrodes (address electrodes) 14 are first printed on a glass substrate 12 to have a given pattern and have a thickness of 20 $\mu$m, and are sintered.

Next, as shown in FIG. 8(B), an inorganic paste comprising low melting-point glass binder and an organic solvent is applied into a multilayer form by screen printing, and then is dried at a temperature of 120° C. for 20 minutes, so as to form a barrier-ridge-forming layer 16*a* having a film thickness of 200 $\mu$m.

As shown in FIG. 8(C), photo resist layer (photosensitive dry film) 30 is laminated to cover the whole of the upper surface of the barrier-ridge-forming layer 16*a*. As the photosensitive dry film, Ordyl BF603 (manufacture by Tokyo Ohka Kogyo Co., Ltd.) and the like can be used.

As shown in FIG. 8(C), a film mask 32 is put on the upper surface of the photosensitive dry film 30 and, in this example, ultraviolet rays UV are selectively irradiated thereto. Thereafter, an aqueous solution of sodium carbonate (0.2 wt. %) or the like washes the material irradiated with the ultraviolet rays so that the portions, which are irradiated with the ultraviolet rays, are removed.

As shown in FIG. 8(D), by this removing treatment, masks 30*a*, which are not irradiated with the ultraviolet rays, remain on predetermined positions of the barrier-ridge-forming layer 16*a*.

Next, portions of the barrier-ridge-forming layer 16*a* to which the masks 30*a* are not applied are subjected to the jet treatment at an air flow of 600 Nl/minute, using as an abrasive the organic material surface-treated with the inorganic material (for example, corn starch coated with silicon (average particle size: 13 $\mu$m)).

Figure 9:
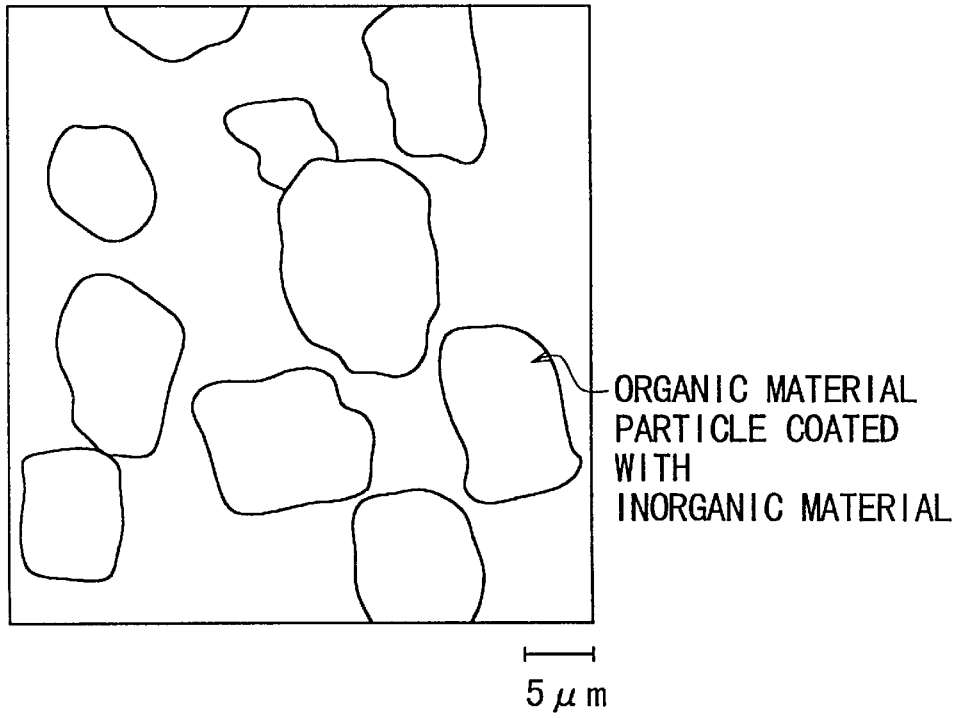
FIG. 9 is a view showing particle sizes and shapes of a coated abrasive of this invention.

As shown in FIG. 8(E), the barrier ridges 16 are formed thereby. In this example, the barrier-ridge-forming layer 16*a* is removed until the address electrodes 14 are exposed. An example of particles of the organic material surface-treated with the inorganic material is shown in FIG. 9.

By removing said portions from the barrier-ridge-forming layer 16*a* by the above jet treatment, discharge spaces surrounded by the barrier ridges 16 make their appearance.

As shown in FIG. 8(F), these discharge spaces are filled with red, blue and green fluorescent substance pastes. They are dried at 130° C. for 10 minutes to form fluorescent substance layers 18.

Next, as shown in FIG. 8(G), portions of the fluorescent substance layers 18, which is positioned on the address electrodes 14, are subjected to jet treatment by using as the abrasive the organic material surface-treated with the inorganic material (the same abrasive as above), until the thickness of the layers 18 becomes a predetermined value. The air flow at this time is also 600 Nl/minute. By this jet treatment, a part of the fluorescent substance layers 18 (18R, 18G and 18B) remains inside the discharge spaces.

Figure 8H:
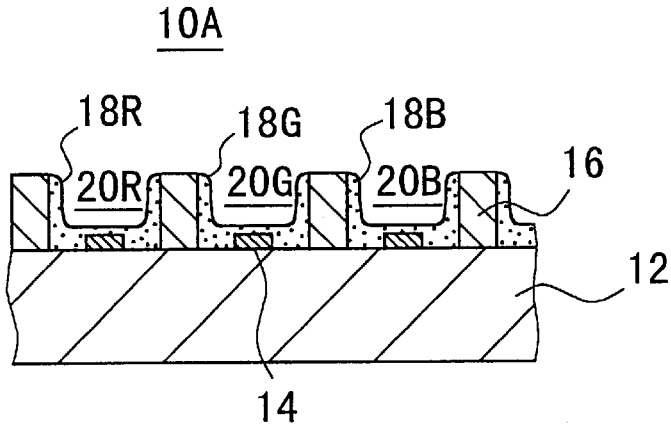

Thereafter, as shown in FIG. 8(H) , the resist masks 30*a* are stripped and removed so as to obtain a back side section 10A having display cells 20 (20R, 20G and 20B).

Since the surface of the fluorescent substance layers 18 resulting from the removal by using the organic material coated with the inorganic material as the abrasive becomes smooth, luminous performance (variations of brightness), luminous efficiency and the like are improved.

The abrasive used for the jet treatment is composed of the organic material surface-treated with the inorganic material as described above so that the abrasive particle thereof becomes roundish as shown in FIG. 9. The particle is, preferably, spherical bodies.

As these organic material particles, the particles made of starch such as, rice starch, potato starch and potato starch, coffee, bean-curd reuse, an apricot, a walnut, and resins such as nylon, polycarbonate, benzoguanamine, melamine, polystyrene, methyl polymethacrylate and acrylic polyethylene, other than the aforementioned corn starch may be used. These particles of a single type may be used, or these of a mixture of 2 or more types may be also used. They have a Mohs' hardness of 1–4.

Figure 10:
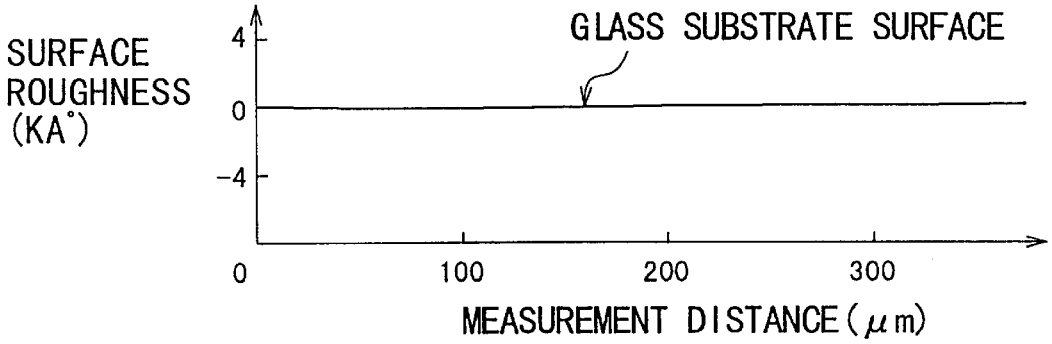
FIG. 10 is a property view showing glass surface roughness after the jet treatment is carried out in this invention.

By using the roundish particle of the abrasive including the organic material having a Mohs' hardness of 1–4 as described above, even if the abrasive is jetted to the surface of the glass substrate 12 and the surface of the address electrodes 14, it is not feared that they are injured. This is because the glass substrate 12 has Mohs' hardness of 6 and the address electrodes 14 have Mohs' hardness of 4. Thus, it has been found that the surface roughness hardly changes from the value before the jet treatment, as shown in FIG. 10. If the abrasive is angular or has a Mohs' hardness over 4, the glass substrate 12 and/or the address electrodes 14 are liable to be damaged.

Figure 11:
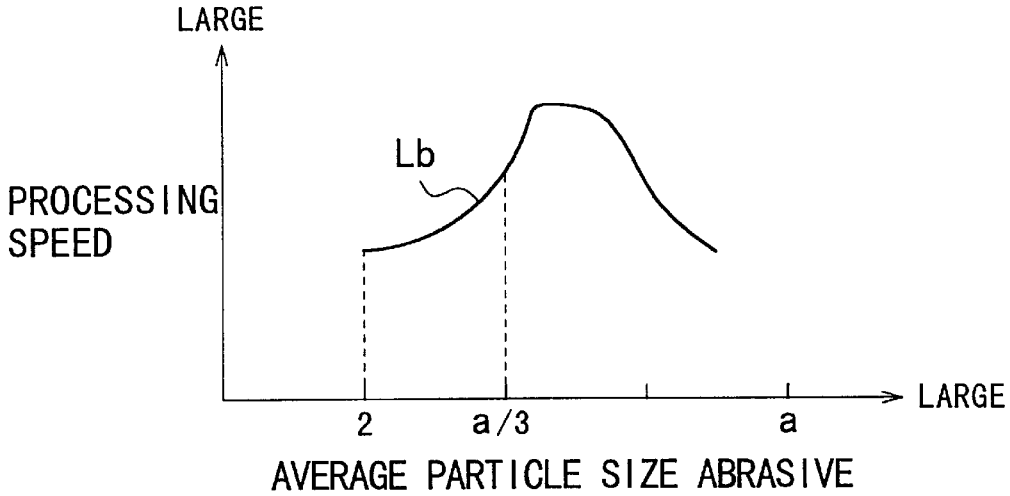
FIG. 11 is a property view showing a relationship between average particle sizes of the abrasive and processing speed.

The maximum particle size of the used organic material is smaller than the distance (a) between the barrier ridges 16 and 16, and the average particle size thereof ranges from 2 μm to one third of the distance (a) between the barrier ridges. This is because the processing speed of the abrasive for the barrier-ridge-forming layer 16*a* varies depending on the average particle size of the abrasive, as shown by the curve Lb in FIG. 11, and the processing speed becomes maximum when the average particle size of the organic material particle becomes one third of the distance (a) between the barrier ridges 16 and 16.

If the average particle size of the organic material is over a/3, the particle size becomes too large and consequently the processing speed drops. This is because the abrasive including the organic material having the average particle size of over a/3 is liable to fit between the barrier ridges 16 (in the very small spaces) and it is feared that the barrier-ridge-forming layer 16*a* at the lower side of the barrier ridges 16 cannot be processed. If the average particle size of the organic material is 2 μm or less, the drop in the processing speed becomes remarkable and the abrasive particles are not practical.

Figure 12:
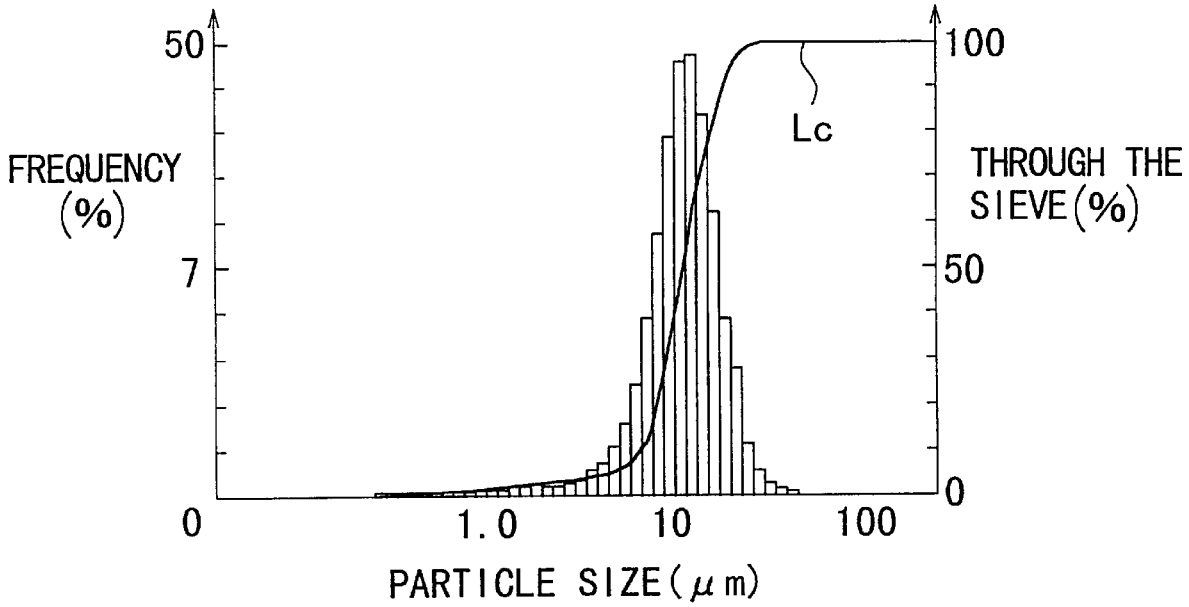
FIG. 12 is a property view showing a relationship between the particle size and the frequency of an abrasive of this invention.

Besides, by coating the surface of the organic material with an inorganic material as described above, the particle size of the abrasive also becomes large. FIG. 12 shows the distribution of particle sizes of the abrasive, and in this figure the distribution of particle sizes of the cornstarch coated with silicon is shown.

As is clear from the same figure, particles of 1 μm or less size are very few. This is also clear from the curve Lc showing the accumulated amount of particles passed "through the sieve". For this reason, from the graph as shown in FIG. 10, it has been confirmed that such the abrasive is not liable to adhere to the surface of the glass substrate 12 and, therefore, the surface of the glass substrate 12 does not swell and the surface roughness hardly changes from the value before the jet treatment is carried out.

Therefore, in this invention, even if the barrier ridges 16 are formed or fluorescent substance layers 18 are removed by using the aforementioned abrasive, it has not been recognized that the glass substrate 12 and the address electrodes 14 deteriorate, nor that the abrasive adheres to the surface of the electrodes. As a result, a high-quality PDP device has been obtained, which neither exhibits the variations in luminous brightness nor these of operation voltages.

As the inorganic material with which the organic material is coated, silicon oxide ($SiO_2$), silicon nitride ($Si_3N_4$) and the like other than silicon are available. Among these, corn starch coated with silicon is particularly appropriate in the jet treatment since it hardly damages the glass substrate 12 and address electrodes 14.

The method of the present invention is not limited to the aforementioned manufacturing process. The above-mentioned abrasive may be used only in the step of removing unnecessary portions from the barrier-ridge-forming layer 16*a*. Where the barrier-ridge-forming layer 16*a* is not formed by overlapping coating but the barrier ridges 16 are directly formed by a thick film printing method, jet treatment using the abrasive concerned with the present invention can be used in the step of removing from the fluorescent substance layers 18 unnecessary portions which are positioned on the address electrodes 14. In this case, the surface of the fluorescent substance layers 18 resulting from the removal becomes smooth.

Flat display panel devices to which the present invention can be applied are not limited to the aforementioned PDP device.

The invention may be embodied in other specific forms without departing from the sprit or essential characteristics thereof. The present embodiments are therefore to be considered in all respects as illustrative and not respective, the scope of the invention being indicated by the appended claims rather than by the foregoing description and all changes which come within the meaning and range of equivalency of the claims are therefore intended to be embraced therein.

What is claimed is:

1. A method for manufacturing a flat display panel device comprising:

forming an electrode pattern on a substrate;

forming a barrier-ridge-forming layer over a whole surface of a substrate having the electrode pattern; and removing unnecessary portion from the barrier-ridge-forming layer by jetting an abrasive thereto, so as to form a barrier ridge;

wherein an organic material particle coated with an inorganic material is used as the abrasive for removing the unnecessary portion from the barrier-ridge-forming layer.

2. The method according to claim 1, wherein the flat display panel device is a plasma display panel.

3. The method according to claim 1, wherein the barrier-ridge-forming layer is an inorganic material layer.

4. The method according to claim 1, wherein the organic material having a Mohs' hardness within the range from 1 to 4 is used.

5. The method according to claim 1, wherein a shape of the organic material particles coated with an inorganic material is roundish or spherical.

6. The method according to claim 1, wherein as for particle sizes of the organic material, when the distance between the barrier ridges is a $\mu$m, its maximum particle size is smaller than a $\mu$m and its average particle size is within the range from 2–a/3 $\mu$m.

7. The method according to claim 1, wherein the organic material is composed of a carbohydrate or an organic high molecular compound.

8. A method for manufacturing a flat display panel device comprising:

forming an electrode pattern on a substrate;

forming a barrier-ridge-forming layer over a whole surface of the substrate having the electrode pattern;

removing unnecessary portion from the barrier-ridge-forming layer by jetting an abrasive, so as to form a barrier ridge;

filling the removed portion of the barrier-ridge-forming layer with fluorescent paste layer; and removing unnecessary portion from the fluorescent paste layer by jetting the abrasive until obtaining a given discharge space;

wherein an organic material particle coated with an inorganic material is used as the abrasive for removing unnecessary portion from the barrier-ridge-forming layer and/or the fluorescent paste layer.

9. The method according to claim 8, wherein the flat display panel device is a plasma display panel.

10. The method according to claim 9, wherein the organic material having a Mohs' hardness within the range from 1 to 4 is used.

11. The method according to claim 8, wherein the barrier-ridge-forming layer is an inorganic material layer.

12. The method according to claim 8, wherein a shape of the organic material particles coated with an inorganic material is roundish or spherical.

13. The method according to claim 8, wherein as for particle sizes of the organic material, when the distance between the barrier ridges is a $\mu$m, its maximum particle size is smaller than a $\mu$m and its average particle size is within the range from 2–a/3 $\mu$m.

14. The method according to claim 8, wherein the organic material is composed of a carbohydrate or an organic high molecular compound.

* * * * *